US007829807B2

(12) United States Patent
Aisenbrey

(10) Patent No.: US 7,829,807 B2
(45) Date of Patent: Nov. 9, 2010

(54) LOW COST KEY ACTUATORS AND OTHER SWITCHING DEVICE ACTUATORS MANUFACTURED FROM CONDUCTIVE LOADED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 1052 days.

(21) Appl. No.: 11/541,187

(22) Filed: Sep. 29, 2006

(65) Prior Publication Data

US 2007/0023272 A1 Feb. 1, 2007

Related U.S. Application Data

(60) Division of application No. 10/811,082, filed on Mar. 26, 2004, now Pat. No. 7,115,825, and a continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/463,368, filed on Apr. 16, 2003, provisional application No. 60/484,458, filed on Jul. 2, 2003, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.
*H01H 1/02* (2006.01)

(52) U.S. Cl. ..... 200/262; 200/5 A

(58) Field of Classification Search ..... 200/262
See application file for complete search history.

(56) References Cited

U.S. PATENT DOCUMENTS

| | | | | |
|---|---|---|---|---|
| 3,760,137 | A * | 9/1973 | Shimojo et al. | 200/263 |
| 6,595,653 | B2 * | 7/2003 | Saito et al. | 362/84 |
| 6,936,783 | B2 * | 8/2005 | Kawaguchi et al. | 200/514 |
| 6,960,735 | B2 * | 11/2005 | Hein et al. | 200/600 |
| 7,115,825 | B2 * | 10/2006 | Aisenbrey | 200/262 |

* cited by examiner

*Primary Examiner*—Michael A Friedhofer
*Assistant Examiner*—Lheiren Mae A Caroc
(74) *Attorney, Agent, or Firm*—Douglas Schnabel

(57) ABSTRACT

Key actuators and other switching devices are formed of a conductive loaded resin-based material. The conductive loaded resin-based material comprises micron conductive powder(s), conductive fiber(s), or a combination of conductive powder and conductive fibers in a base resin host. The ratio of the weight of the conductive powder(s), conductive fiber(s), or a combination of conductive powder and conductive fibers to the weight of the base resin host is between about 0.20 and 0.40. The micron conductive powders are formed from non-metals, such as carbon, graphite, that may also be metallic plated, or the like, or from metals such as stainless steel, nickel, copper, silver, that may also be metallic plated, or the like, or from a combination of non-metal, plated, or in combination with, metal powders. The micron conductor fibers preferably are of nickel plated carbon fiber, stainless steel fiber, copper fiber, silver fiber, or the like. The conductive loaded resin-based key actuators and other switching devices can be formed using methods such as injection molding compression molding or extrusion. The conductive loaded resin-based material used to form the key actuators and other switching devices can also be in the form of a thin flexible woven fabric that can readily be cut to the desired shape.

8 Claims, 10 Drawing Sheets

LOW COST KEY ACTUATORS AND OTHER SWITCHING DEVICE ACTUATORS MANUFACTURED FROM CONDUCTIVE LOADED RESIN-BASED MATERIALS

This is a division of patent application Ser. No. 10/811,082, filed on Mar. 26, 2004 now U.S. Pat. No. 7,115,825, and assigned to the same assignee as the present invention. This divisional patent application claims priority to the U.S. Provisional Patent Application 60/463,368, filed on Apr. 16, 2003 and to the U.S. Provisional Patent Application 60/484,458, filed on Jul. 2, 2003 which are herein incorporated by reference in their entirety.

This Patent Application is a Continuation-in-Part of U.S. patent application Ser. No. 10/309,429, filed on Dec. 4, 2002, now issued as U.S. Pat. No. 6,870,516, also incorporated by reference in its entirety, which is a Continuation-in-Part application of U.S. patent application Ser. No. 10/075,778, filed on Feb. 14, 2002, now issued as U.S. Pat. No. 6,741,221, which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to key actuators and other switching devices and, more particularly, to key actuators and other switching devices actuators molded of conductive loaded resin-based materials comprising micron conductive powders, micron conductive fibers, or a combination thereof, homogenized within a base resin when molded. This manufacturing process yields a conductive part or material usable within the EMF or electronic spectrum(s).

(2) Description of the Prior Art

Key actuators and other electrical switching devices are used in many applications. Such switches are often the primary means of control for machines, mechanisms, computers, tools, and communications devices. Key actuators are found in standard computer keyboards, mobile and stationary telephones, industrial controls, human-machine interfaces, calculators, musical instruments, and PDA devices, among other applications. Other simple switches are found on computer mice, appliances, computer joysticks, manual machine controls, control grips, and the like.

All switches are essentially binary transducers that are either in an open state or in a closed state. In the open state, switches may have almost infinite impedance. In the closed state, the impedance drops to almost zero impedance. The binary character of switches is well-suited to digital computing technology wherein each switch state can be assigned a '0' or a '1' designation.

A large number of switching mechanisms are found in the art. In contact switches, a circuit is opened or closed by direct contact between conductive elements. This is the method used in a residential lighting switch. The conductive elements can be metal wires, traces, brushes, tabs, or the like. Alternatively, liquid metal, such as in the case of a mercury switch, can be used as the direct contact path. Indirect switching methods are also used. For example, a magnetic reed switches, hall effect switches, and ferrite core switches use magnetic fields to control conductive paths. Another important indirect switching technique is capacitance switching. In a capacitance switch, the open and closed states correspond to two different capacitance values that the switch may exhibit.

A sensing circuit is used to distinguish the capacitance value, and therefore the state, of the switch.

Of particular importance to the present invention are the switching mechanisms used in most keypad switches: direct contact (conductor-to-conductor) and indirect contact (capacitance-based). In either case, the keying mechanism is based a first conductor, typically attached to the underside of the keypad, and a second conductor, typically located on a circuit board underlying a particular keypad in the array of keypads. In a direct contact keying mechanism, when the keypad is pressed, the first conductor on the keypad is forced into direct contact with the second conductor on the circuit board matrix to complete a circuit. A digital decoding integrated circuit then decodes this completed circuit to determine which key was pressed. In the case of the capacitance-based, indirect contact, the effect of pressing the keypad is to reduce the distance between the first conductor and the second conductor. The first and second conductors from the plates of a capacitor. In the pressed state, the plates of the capacitor are closer and, therefore, the capacitance of this matrix location is increased. The digital decoding integrated circuit detects this change in capacitance using, for example, a RC time-constant measurement.

In either the direct or indirect switching case, the keypad and circuit board matrix contacting conductors are found to comprise metals, such as copper, silver, gold, and the like, or conductive inks, or carbon pills. Conductive ink is typically silk screen printed onto the circuit board and/or the underside of the keypad. Carbon pills are typically used on the underside of the keypad. Carbon pills are carbon, or graphite, tablets that are molded into the keypad. Alternatively, carbon pills may comprise carbon impregnated silicon rubber.

Other switching actuators, such as rotary switches, toggle switches, push-button switches, and rocker switches, such as found in some light switches, are also of importance to the present invention. The switching contacts in these switching actuators are more typically metal-to-metal although conductive inks and carbon pills may also be used.

Several prior art inventions relate to key actuators and other electrical switching devices. U.S. Patent Application 2001/0025065 to Matsumora teaches an encoder switch comprising a rotating code disk with a conductive resin pattern formed thereon. The conductive resin comprises a resin material further comprising silver powder, silver-coated carbon beads, or both silver powder and silver-coated carbon beads. Phosphor bronze brushes are used to contact the code disk pattern. U.S. Patent Application 2003/0203668 to Cobbley et al discloses an electrical interconnect device. The interconnect device comprises a conductive resi/catalyst system disposed between two conductive plates. As the plates are forced toward each other, insulating coatings around the conductive particles in the resin are broken to thereby expose the conductive particles. The interconnecting path is formed by these conductive particles. U.S. Pat. No. Re. 34,642 to Maenishi et al shows an electric contact switching device comprising, in part, a non-conductive resin. U.S. Pat. No. 6,362,976 to Winters et al describes a keypad comprising silicone buttons over silicone domes. When depressed, the silicone buttons deform the silicone domes to cause carbon pills to contact across traces on a printed circuit board. The contacting carbon pills short traces together. U.S. Pat. No. 4,503,410 to Hochreutiner describes an electromagnetic relay device having two contact pills each comprising an electrically and magnetically conducting material.

SUMMARY OF THE INVENTION

A principal object of the present invention is to provide an effective key actuator or other switching device.

A further object of the present invention is to provide a method to form a key actuator or other switching device.

A further object of the present invention is to provide a key actuator or other switching device molded of conductive loaded resin-based materials.

A yet further object of the present invention is to provide key actuator or other switching device with a low manufacturing cost.

A yet further object of the present invention is to provide key actuator or other switching device with low closed state resistance.

A yet further object of the present invention is to provide key actuator or other switching device with a long life expectancy.

A yet further object of the present invention is to provide a key actuator or other switching device molded of conductive loaded resin-based material where the resistance or longevity characteristics can be altered or the visual characteristics can be altered by forming a metal layer over the conductive loaded resin-based material.

A yet further object of the present invention is to provide methods to fabricate a key actuator or other switching device from a conductive loaded resin-based material incorporating various forms of the material.

A yet further object of the present invention is to provide a method to fabricate a key actuator or other switching device from a conductive loaded resin-based material where the material is in the form of a fabric.

In accordance with the objects of this invention, a switching device is achieved. The device comprises a first conductive terminal, a second conductive terminal, and a conductive pill. The conductive pill moves between an open position and a closed position. The first and second terminals are shorted in the closed position. The first and second terminals are not shorted in the open position. The conductive pill comprises a conductive loaded, resin-based material comprising conductive materials in a base resin host.

Also in accordance with the objects of this invention, a keypad device is achieved. The device comprises a first conductive terminal, a second conductive terminal, a pad structure, a spring structure, and a conductive pill. The conductive moves between an open position and a closed position. The first and second terminals are shorted in the closed position. The first and second terminals are not shorted in the open position. The conductive pill, the pad structure, and the spring structure all comprise a conductive loaded, resin-based material comprising conductive materials in a base resin host.

Also in accordance with the objects of this invention, a switching device is achieved. The device comprises a conductive terminal and a conductive pill. The conductive pill moves between an open position and a closed position. Capacitance coupling between the conductive terminal and the conductive pill is greater in the closed position than in the open position. The conductive pill comprises a conductive loaded, resin-based material comprising conductive materials in a base resin host.

Also in accordance with the objects of this invention, a method to form a switching device is achieved. The method comprises providing a conductive loaded, resin-based material comprising conductive material in a resin-based host. The conductive loaded, resin-based material is molded into a conductive pill in a switching device. The switching device comprises a conductive terminal and a conductive pill. The conductive pill moves between an open position and a closed position.

BRIEF DESCRIPTION OF THE DRAWINGS

In the accompanying drawings forming a material part of this description, there is shown.

DESCRIPTION OF THE PREFERRED EMBODIMENTS

Figure 1:
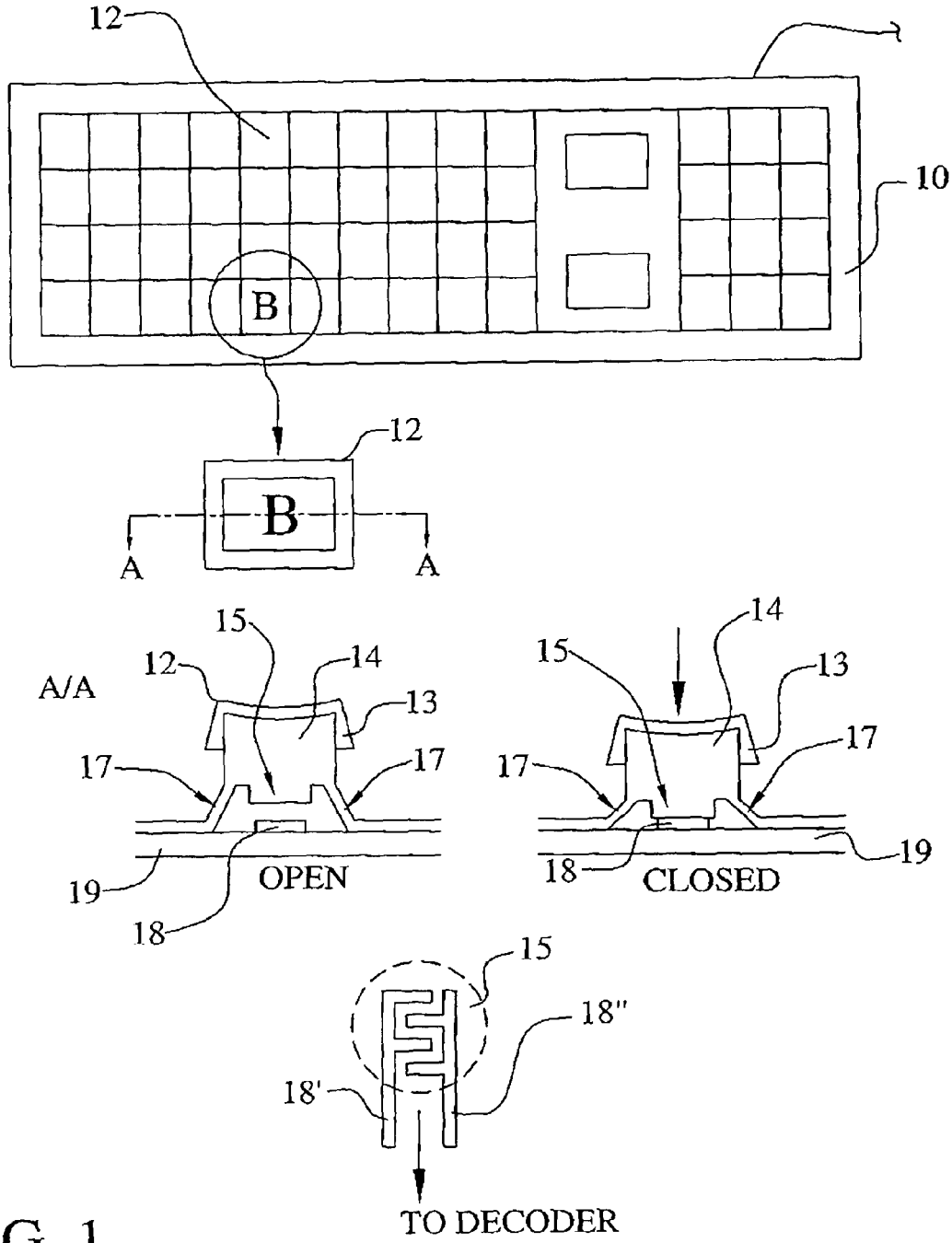
FIG. 1 illustrates a first preferred embodiment of the present invention showing a domed elastomeric keyboard actuator having direct conductive contacts comprising a conductive resin-based material.

This invention relates to key actuators and other electrical switching devices molded of conductive loaded resin-based materials comprising micron conductive powders, micron conductive fibers, or a combination thereof, homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of key actuators and other electrical switching devices fabricated using conductive loaded resin-based materials depend on the composition of the conductive loaded resin-based materials, of which the loading or doping parameters can be adjusted, to aid in achieving the desired structural, electrical or other physical characteristics of the material. The selected materials used to fabricate the key actuators and other electrical switching devices are homogenized together using molding techniques and or methods such as injection molding, over-molding, thermo-set, protrusion, extrusion or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of key actuators and other electrical switching devices significantly lowers the cost of materials and the design and manufacturing processes used to hold ease of close tolerances, by forming these materials into desired shapes and sizes. The key actuators and other electrical switching devices can be manufactured into infinite shapes and sizes using conventional forming methods such as injection molding, over-molding, or extrusion or the like. The conductive loaded resin-based materials, when molded, typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or in any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion to create desired shapes and sizes. The molded conductive loaded resin-based materials can also be stamped, cut or milled as desired to form create the desired shape form factor(s) of the heat sinks. The doping composition and directionality associated with the micron conductors within the loaded base resins can affect the electrical and structural characteristics of the key actuators and other electrical switching devices, and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming key actuators and other electrical switching devices that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a to corrosion and/or metal electrolysis resistant conductive loaded resin-based material is achieved.

The homogeneous mixing of micron conductive fiber and/or micron conductive powder and base resin described in the present invention may also be described as doping. That is, the homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the homogeneous mixing of micron conductive fiber and/or micron conductive powder into a base resin.

Referring now to FIG. 1, a first preferred embodiment of the present invention is illustrated. Several important features of the present invention are shown and discussed below. Referring now to FIG. 1, a keyboard actuator is illustrated. A keyboard 10 is shown. Such keyboards 10 are commonplace as input devices to computer systems. While a standard text keyboard 10 is shown, it is further understood that the keyboard 10 may further be construed as any type of keypad input device such as found on or used conjunction with mobile and stationary telephones, industrial controls, human-machine interfaces, calculators, musical instruments, PDA devices, and the like. The keyboard 10 comprises an array of key actuators 12, or keypads. This array of keys may be configured in any arrangement as dictated by the particular application. In a typical computer keyboard, the alphabetical characters are arranged in the traditional QWERTY arrangement.

A matrix circuit underlies the array of keypads. The matrix circuit is a grid of circuits underneath the keys that is used to decode which key has been pressed. For a contact-based keyboard, each circuit is broken at the point below the specific key as shown in the lower illustration of FIG. 1. Here, the circuit routing for the "B" key comprises a first conductor 18' and a second conductor 18" that are interlaced but not connected. When the keypad 12 is pressed down, the conductive contact pill 15 of the keypad 12 contacts both the first conductor 18' and a second conductor 18" to thereby complete the "B" circuit. An integrated circuit decoding circuit, not shown, senses the completion of the "B" circuit and issues a digital code, such as ASCII, to the computer CPU.

The cross section of the keypad shows the relationship between the key elements of the device. The key matrix circuit 19 comprises a circuit board 19 with conductive traces 18 or lines formed thereon. The keypad 12 comprises a pad structure 14, a contact pill structure 15, and a spring structure 17. Further, the keypad 12 may comprise an outer shell structure 13. The pad structure 14 provides a substantial object for the operator to strike. The contact pill structure 15 provides a conductive terminal to short across the open circuit traces 18' and 18". The spring structure 17 provides a mechanical force to hold the keypad 12 above the key matrix plane 19, to provide a useful resistance, or "feel," for operator data entry, and to return the keypad 12 to the nominal (open) position after a key stroke. The outer shell structure 13 provides a suitable surface characteristic for environmental protection, character display, look and feel, and the like.

The first preferred embodiment shows a domed elastomeric keypad having a direct contact mechanism. By domed elastomeric, the present application means to describe a keypad 12 wherein the pad structure 14 and the spring structure 17 are formed of a single elastic material into a domed-like structure. More particular to this preferred embodiment, the pad structure 14 and the spring structure 17, and the contact pill structure 15 are all formed of a conductive loaded resin-based material according to the present invention. A base resin material, that exhibits the necessary elastomeric characteristics for the spring structure 17 is selected. A conductive loaded resin-based material is then formed by homogeneous mixing of micron conductive fibers and/or micron conductive powders as described in the present invention. This conductive loaded resin-based material is molded to form the combined pad structure 14 and spring structure 17, and contact pill structure 15 of the keypad 12.

The resulting keypad structure has several advantages over the prior art. Among these advantages, the combined inner structure 14, 15, and 17 can be molded in a single step without further assembly to thereby save manufacturing costs. In addition, the electrical characteristics of the conductive loaded resin-based contact pill 15 can be optimized based on the conductive doping selected. For example, a contact pill 15 having a resistance of about 1 Ohm can be manufactured using the conductive loaded resin-based material. By comparison, a carbon pill will exhibit a resistance of about 200 Ohms. Further, the prior art carbon pill will wear out at about 1 million cycles. However, the conductive loaded resin-based pill 15 will exhibit much less wear and is virtually a 'no wear out' pill. Further yet, the domed elastomeric structure of the present invention will exhibit longer useful life due to the material properties of the conductive loaded resin-based material used to form the spring structures 17. Further, the conductive loaded resin-based material does not corrode or fail due to electrolysis. This is a significant advantage over prior art keypads, particularly those with metal terminals or mechanical structures. The outer shell structure 13, if used, may be molded over the inner structure 14, 15, and 17 or visa versa. Alternatively, the inner structure 14, 15, and 17 may be pressure fitted into the outer structure 19.

Figure 14:
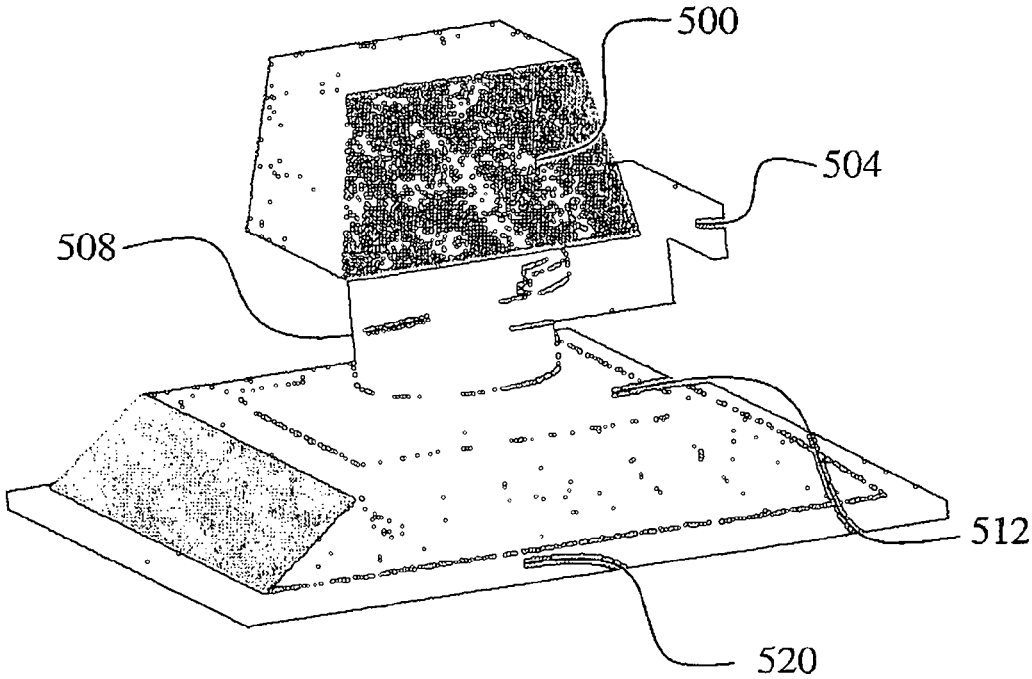
FIG. 14 illustrates an isometric view of a domed elastomeric keyboard actuator comprising a conductive resin-based material.

As an additional, though optional, feature, the conductive traces 18 on the matrix board 19 may also comprise a conductive loaded resin based material according to the present invention. For example, these traces 18, or lines, can be overmolded onto an insulating board 19. Referring now to FIG. 14, a particular implementation of domed elastomeric keypad is illustrated in an isometric view. The embodiment shows a key top 500, a plunger section 504, a protective bezel, a conductive elastomer comprising conductive loaded resin based material 512, and a printed circuit board 520.

Figure 7:
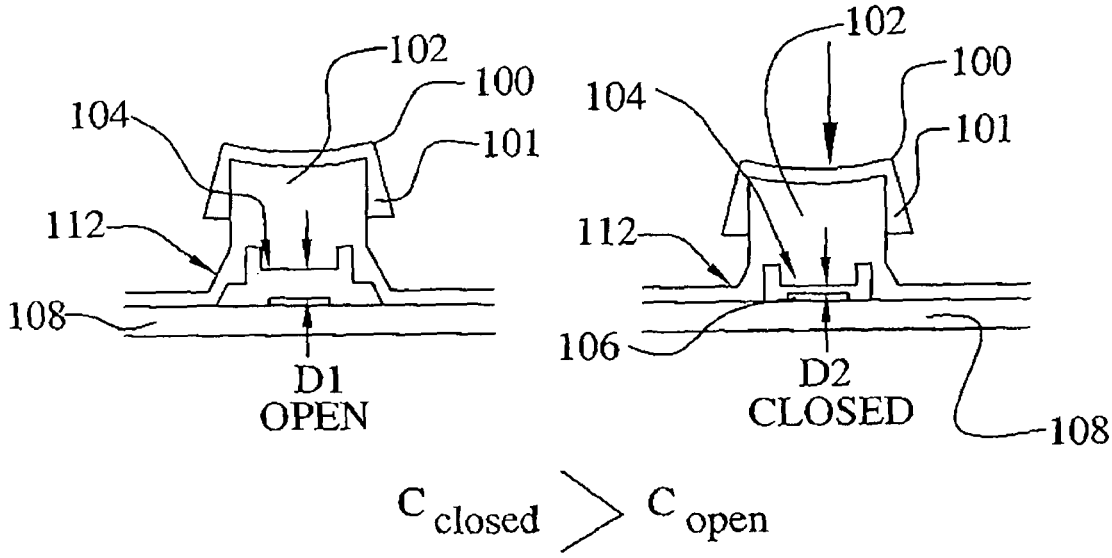
FIG. 7 illustrates a second preferred embodiment of the present invention showing a domed elastomeric keyboard actuator having capacitance conductive contacts comprising a conductive resin-based material.

Referring now to FIG. 7, a second preferred embodiment of the present invention is illustrated. In this case, a domed elastomeric keypad 100 for performing a capacitance contact is shown. As in the first embodiment, the combined pad structure 102 and spring structure 112, and contact pill structure 104 comprises a conductive loaded resin-based material according to the present invention. An outer shell structure 101 is optionally formed over the combined inner structure 102, 104, and 112. In this embodiment, however, the contact pill 104 and the trace 106 on the matrix board 108 do not touch in the CLOSED or pressed position. Instead, in the OPEN position, the contact pill 104 and the trace 106 are separated by a first distance D1. In the closed position, the contact pill 104 and the trace 106 are separated by a second, smaller, distance D2. As a result, the capacitive coupling between the trace 106 and the contact pill 104 is increased in the CLOSED position. In this configuration, the trace 106 merely comprises a closed circuit to the decoder IC, not shown, without the separate, interlaced structure of FIG. 1. The decoder IC detects the capacitance of each key in the matrix to determine if a keystroke has occurred. For example, the decoder IC can measure the RC delay of each matrix circuit to determine the presence or absence of a large capacitor (keystroke).

The formation of the inner structure 102, 104, and 112, and especially the contact pill 104 of conductive loaded resin-based materials brings the several advantages and features listed in the first embodiment above. However, in this capacitor contact method, mechanical or electrical wear of the contact pill 104 is not an issue. In addition, the circuit traces 106 may also comprise the conductive loaded resin-based material as in the first embodiment.

Figure 8:
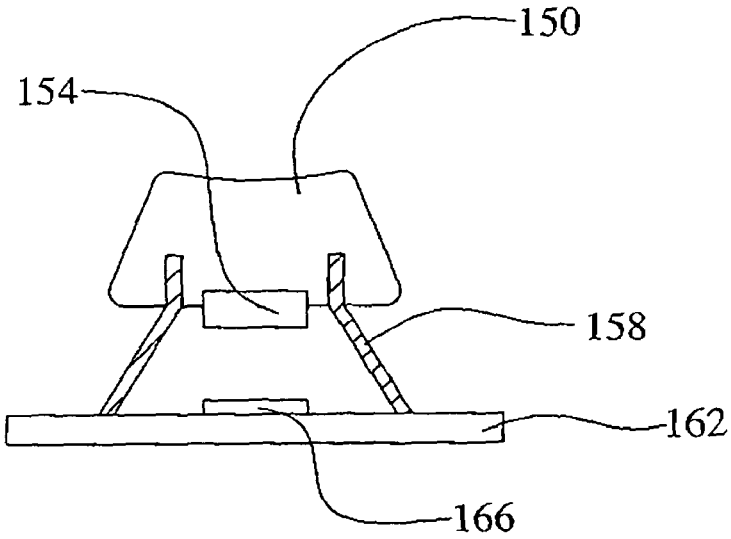
FIG. 8 illustrates a third preferred embodiment of the present invention showing a keyboard actuator having conductive contacts comprising a contact pill molded of conductive resin-based material.

FIG. 8 illustrates a third preferred embodiment of the present invention is illustrated. In this embodiment, a keyboard actuator is formed with a contact pill molded of conductive resin-based material. In this exemplary case, the pad structure 150 and the spring structure 158 are formed from materials other than the conductive loaded resin based material. For example, the pad structure 150 may comprise a polyester-based material while the spring structure 158 comprises steel. As an important feature, a contact pill 154 is formed of conductive loaded resin-based material according to the present invention.

As an exemplary manufacturing technique, a rod of conductive loaded resin-based material is extrusion molded. Contact pills 154 are then cut to size from the molded rod. An advantage of this approach over, for example, injection molding the contact pill 154 to size, is that the cutting process will maximally expose the interconnected matrix of micron conductive fibers and/or micron conductive powder at the sectioned surfaces. The contact pills 154 are then forcibly inserted into the pad structure 150 subassembly. Alternatively, the pad structure 150 is over-molded onto the contact pills 154. As in the first embodiment, this embodiment provides significant advantages in wear and reliability, in low ON-resistance, and in corrosion/electrolysis resistance. The matrix board 162 traces 166 may further comprise a conductive loaded resin-based material. Alternatively, a capacitance contact version of this keypad may be manufactured along the lines of the second preferred embodiment.

Figure 9:
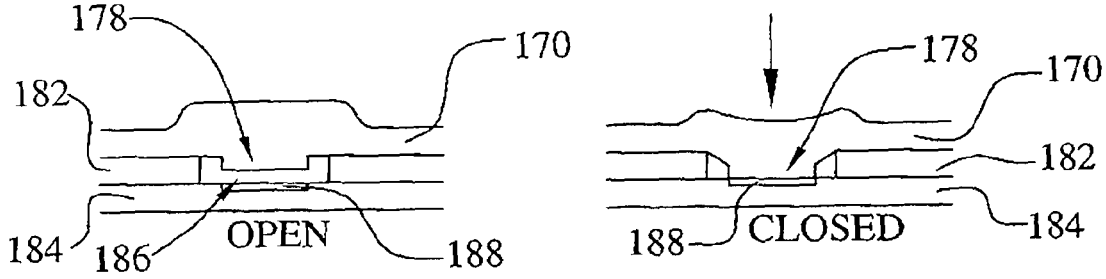
FIG. 9 illustrates a fourth preferred embodiment of the present invention showing a direct membrane keyboard actuator having direct conductive contacts comprising a conductive resin-based material.

Referring now to FIG. 9, a fourth preferred embodiment of the present invention is illustrated. In this embodiment, a direct membrane keyboard actuator is formed with direct conductive contacts comprising a conductive resin-based material. Membrane keyboard actuators are frequently used on keypad applications that must be environmentally sealed. For example, household appliances, military applications, or industrial applications, and the like, where water, dust, or chemicals can come into contact with the keypad are typical applications for membrane keyboard actuators. In this preferred embodiment, the keypad comprises a laminate formed of an outer membrane layer 170, a spacer layer 182, a matrix substrate 184.

The outer membrane layer 170 is formed of conductive loaded resin-based material according to the present invention. The base resin of the outer membrane layer 170 is flexible such that the outer membrane will deform when pressed. The spacer 182 comprises an insulator material to isolate the outer membrane layer 170 from the substrate 184. The outer membrane layer 170 further comprises a contact pill structure 178 at each key location. The use of the conductive loaded resin-based material allows the contact pill topology 178 to be molded directly into the outer membrane layer 170. Optionally, a flexible outer insulator layer, not shown, may be formed overlying the outer membrane layer 170 to provide an electrically isolated operator surface, if needed.

In the nominal state, the spacer 182 maintains a gap 186 between the contact pill structure 178 of the outer membrane layer 170 and the matrix terminal or pad 188 of the substrate 188. When the outer membrane layer 170 is pressed, the conductive contact pill 178 contacts the matrix location 188 to complete circuit for this key. Alternatively, a capacitance based key mechanism may be used where the conductive loaded resin-based contact pill 178 merely comes into close proximity with the matrix pad 188 as described in the third preferred embodiment.

The membrane keyboard actuator provides several advantages over the prior art. The ability to form the outer membrane 170 and the contact pill 178 from a common material and in a single molding process reduces the manufacturing cost. The construction of the contact pill 178 and/or the matrix pad from conductive loaded resin-based material improves the product lifetime, reduces the operating resistance, and eliminates the effects of corrosion and/or electrolysis.

Figure 10:
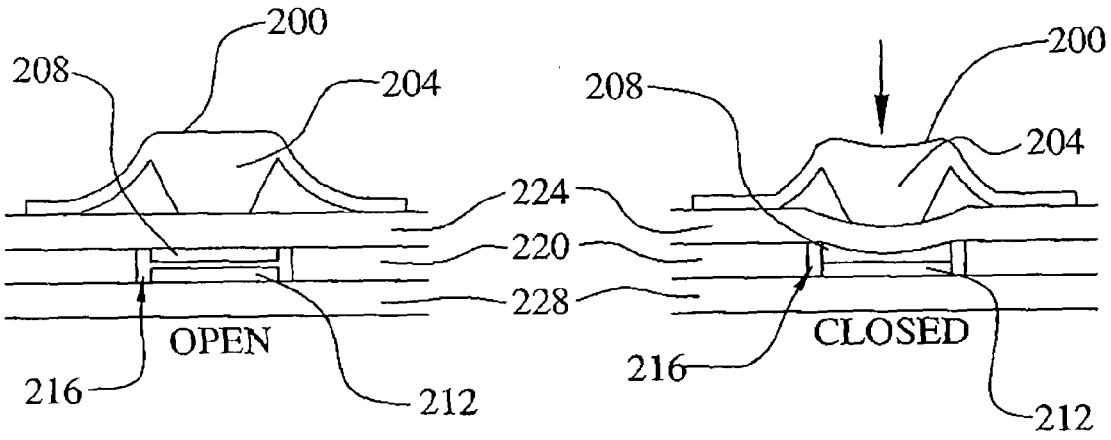
FIG. 10 illustrates a fifth preferred embodiment of the present invention showing an indirect membrane keyboard actuator having direct conductive contacts comprising a conductive resin-based material.

Referring now to FIG. 10, a fifth preferred embodiment of the present invention is illustrated. In this embodiment, an indirect membrane keyboard actuator 200 is formed with direct conductive contacts 208 comprising a conductive resin-based material. This embodiment combines aspects of the first and fourth embodiment to create a keypad 200 that can have the look, feel, and response or a domed elastomeric keypad with the environmental isolation of a membrane contact. The domed elastomeric keypad structure 200 can be formed using any known technique. As shown, the domed elastomeric keypad structure 200 comprises a single elastic material 204 for the pad structure and the spring structure. More preferably, a conductive loaded resin-based material 204 is used for the keypad structure.

In this case, the contacting method is indirect. In the OPEN position, the spacer 220 provides a gap 216 between the upper contact pill 208 and the matrix pad or terminal 212 on the substrate 224. When the keypad 204 is pressed, the outer membrane 224 is deformed. As a result, the contact pill 208 contacts the matrix pad 212 and the keypad is CLOSED. Alternatively, a proximity or capacitance connection may be formed as described above. Preferably, the contact pill 208 comprises a conductive loaded resin-based material according to the present invention. More preferably, both the contact pill 208 and the matrix trace 212 comprise conductive loaded resin-based material.

Figure 11:
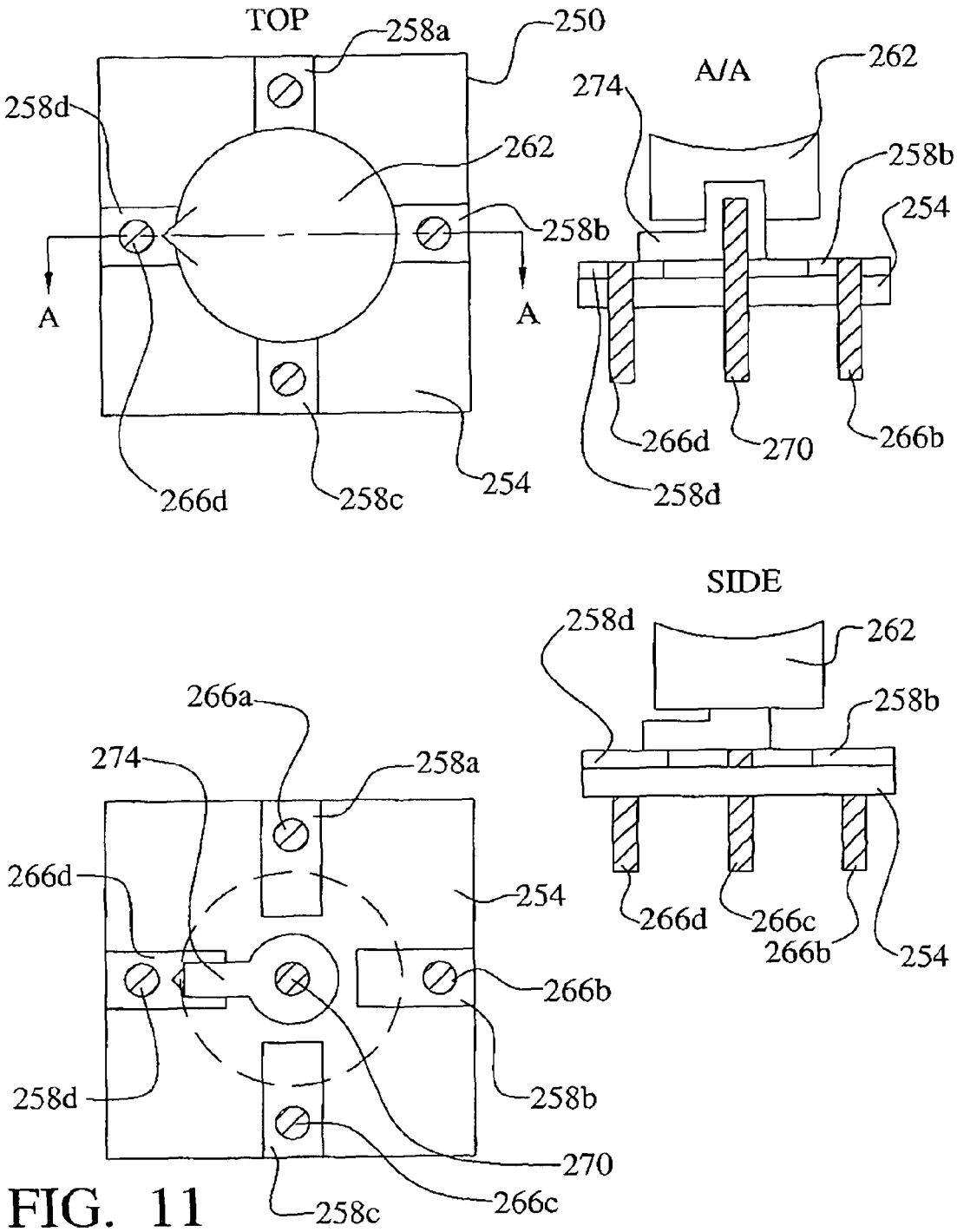
FIG. 11 illustrates a sixth preferred embodiment of the present invention showing a rotary switch mechanism having direct conductive contacts comprising a conductive resin-based material.

Referring now to FIG. 11, a sixth preferred embodiment of the present invention is illustrated. In this embodiment, the novel concept of the present invention is extended to the formation of a rotary switch mechanism 250 having direct conductive contacts 258*a*-258*d* and 274 comprising a conductive resin-based material. Rotary switches are used in many applications where it is necessary to digitally select between any one of several options or settings or combination of setting.

The exemplary rotary switch 250 is just one of many configurations of such switches. A selector terminal 274 is fixably mounted onto a terminal/axle 270. The selector terminal 274 comprises conductive loaded resin-based material according to the present invention. The selector terminal 274 combines the mechanical advantages of the base resin material, such as corrosion/electrolysis resistance and low cost, with low resistance due to the matrix of micron conductive fibers and/or micron conductive powders homogeneously disposed within the base resin. The selector terminal 274 turns on the axle 270 to select between the four outer terminals 258*a*-258*d*. Each of the four outer terminals 258*a*-258*d* also comprises conductive loaded resin-based material and share the same advantages as the selector terminal 274. A selection knob 262 comprises an insulating material, such as a resin-based material, and is fixably mounted onto the selector terminal. An insulating circuit board 254 is used to mechanically support and to electrically isolate each of the five terminals of the rotary switch 250. Solderable posts 266*a*-266*d* and 270 are embedded into the five terminals 258*a*-258*d* and 274. The central post 270 may also form the axle for rotation of the selection terminal 274. Selection of an outer terminal, as shown by terminal 258*d*, by the selection terminal 274 results in a low resistance path between the selection terminal post 270 and the selected terminal post 266*d*.

Figure 12:
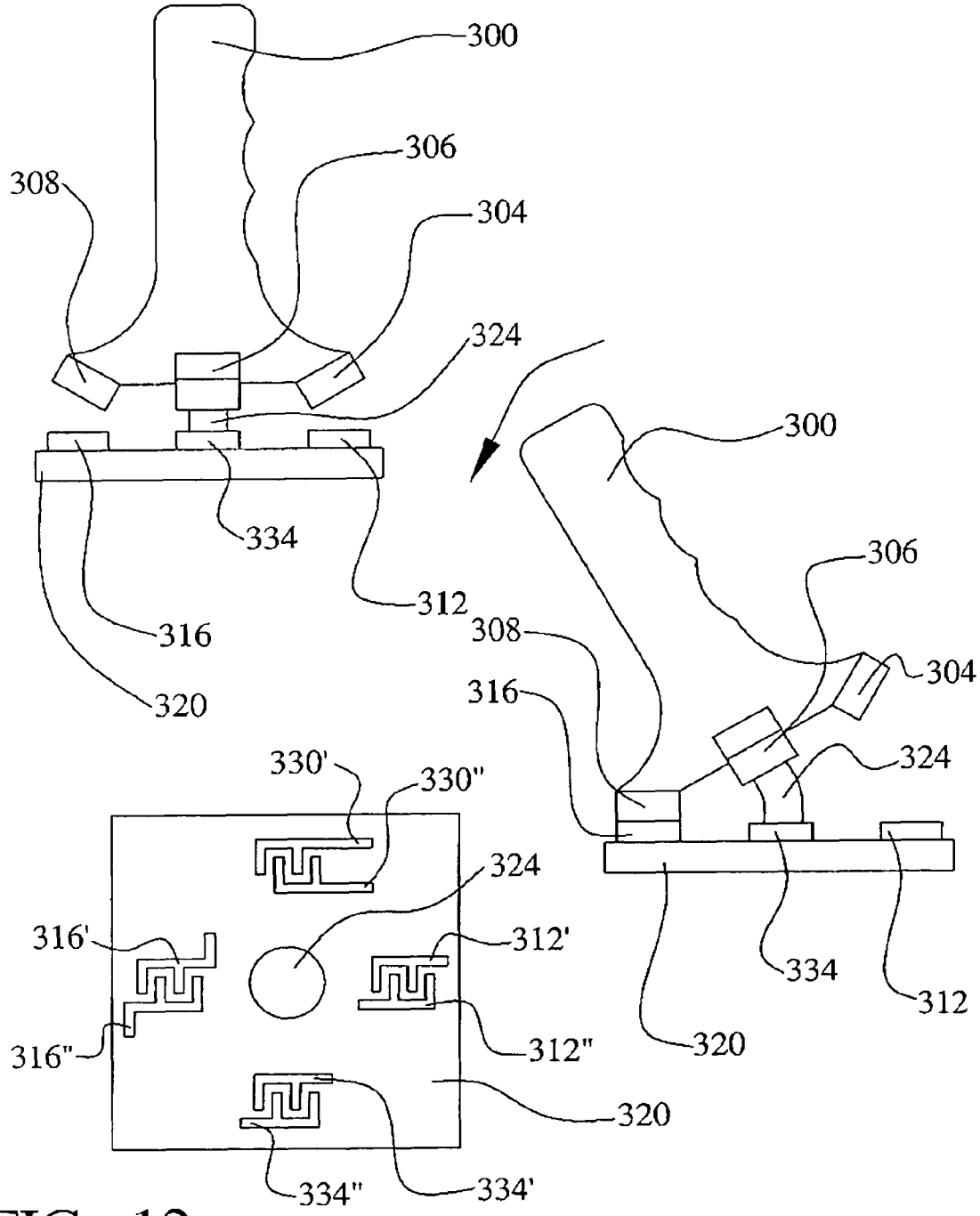
FIG. 12 illustrates a seventh preferred embodiment of the present invention showing a joystick having direct conductive contacts comprising a conductive resin-based material.

Referring now to FIG. 12, a seventh preferred embodiment of the present invention is illustrated. A joystick device 300 has direct conductive contacts comprising conductive resin-based material according to the present invention. Joystick devices are used in many applications to provide control of graphics, as in flight simulation programs, or of mechanical objects, as in heavy machinery or military vehicles. A joystick device 300 allows an operator to input directional controls, such as forward, reverse, left and right, by tilting the stick 300 in the desired direction. In the particular embodiment shown, the simplified joystick 300 has only forward, reverse, left and right control points. The device comprises a gripping handle 300, a flexible mounting post 324, a circuit board 320, directional terminals 312, 316, 330, and 334 on the circuit board 320, and contact terminals 304, 306, and 308 on the grip 300. When the stick 300 is tilted, a grip terminal, such as the left grip terminal 308 contacts the complementary circuit board terminal, such as the left board terminal 316. As a result, the left circuit represented by traces 316' and 316" is closed. A decoder circuit is used to detect which direction, if any, the joystick 300 is tilted.

In the preferred embodiment, the grip terminals 304, 306, and 308 comprise conductive loaded resin based material according to the present invention. These terminals 304, 306, and 308 can be easily molded into the grip and, more preferably, the grip 300 and terminals 304, 306, and 308 comprise a single conductive loaded resin based material and are injection molded as a unit. The board traces and terminals 316', 316", 312', 312", 330', 330", 334', and 334" also preferably comprise conductive loaded resin based material and, more preferably, are over-molded onto the board 320.

Figure 13:
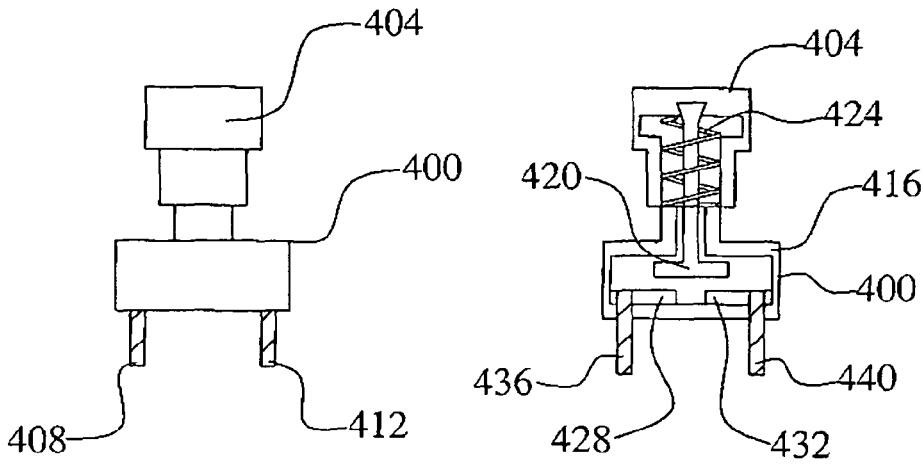
FIG. 13 illustrates an eighth preferred embodiment of the present invention showing a push-button switch having conductive contacts comprising a molded conductive resin-based material.

Referring now to FIG. 13, an eighth preferred embodiment of the present invention showing a push-button switch having conductive contacts comprising a molded conductive resin-based material. Simple switches, such as the push-button switch 400 shown, are used in many applications to provide binary signal control. Many styles of simple switches are possible. The exemplary push-button switch 400 shown comprises a button 404, a chassis 416, a plunger 420, a spring 424, a first terminal 436, a terminal block 428, a second terminal 440, and a second terminal block 432. The operation of the push-button switch 400 is simple. The spring 424 maintains the plunger 420 and button 404 in the up, or OPEN, position. In this position, the plunger 420 does not contact the first or second terminal blocks 428 and 432. When the button is depressed, the plunger 420 is forced down such that the bottom of the plunger 420 contacts the first and second terminal blocks 428 and 432.

In the preferred embodiment, the plunger 420 and/or the terminal blocks 428 and 432 comprise conductive loaded resin-based material according to the present invention. Therefore, when the plunger 420 is down, the simple switch is CLOSED and a short circuit exists between the first terminal 436 and the second terminal 440. The conductive loaded resin-based material creates a conductive path from the first terminal 436 and the second terminal 440 that is of low resistance and that is resistant to corrosion and electrolysis.

Figure 15:
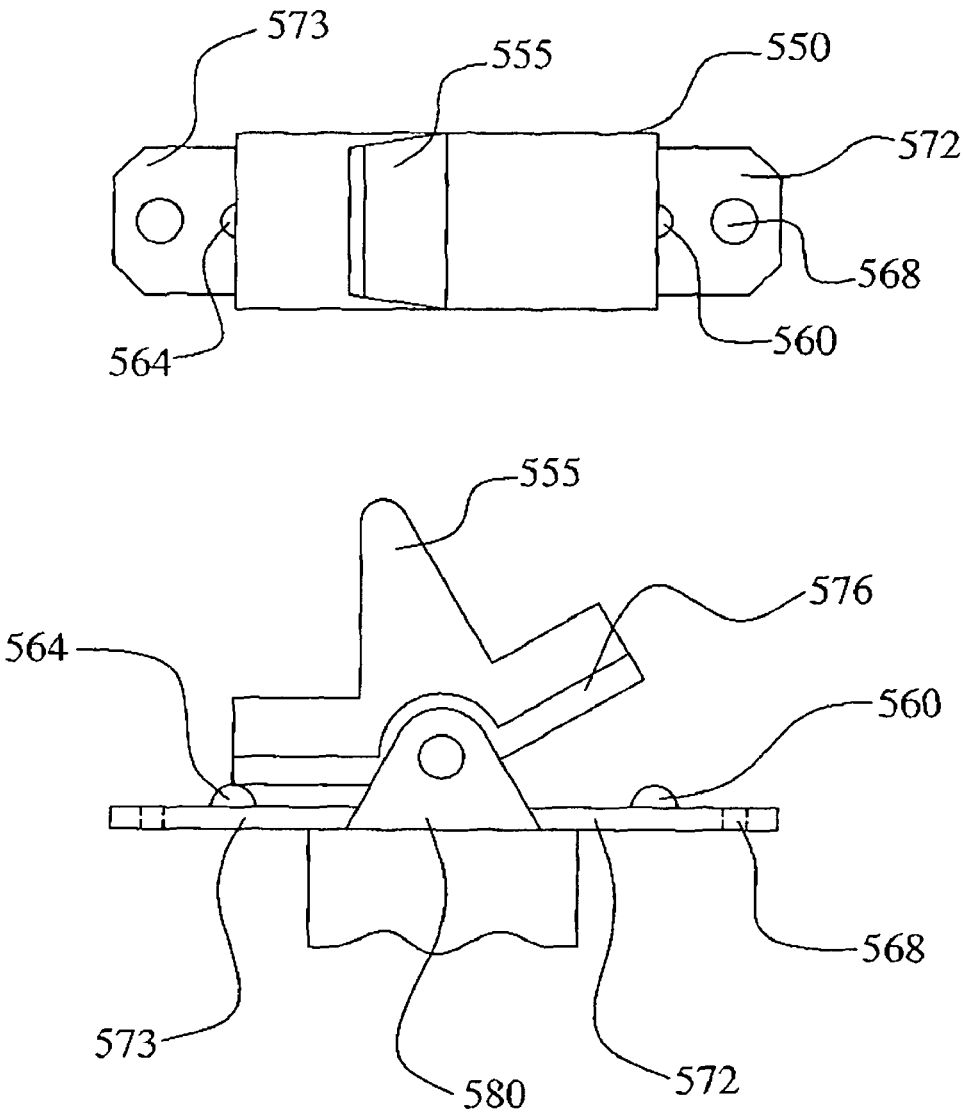
FIG. 15 illustrates a ninth preferred embodiment of the present invention showing a rocker switch having conductive contacts comprising a conductive resin-based material.

Referring now to FIG. 15, a ninth preferred embodiment of the present invention is illustrated. A rocker switch 550 is shown with conductive contacts 560, 564, and 576 comprising a conductive resin-based material. The rocker switch 550 selects between a left side terminal 573 and a right side terminal 572 by moving a switch handle 555 that is mounted on a central fulcrum 580. Typically, the terminals 572 and 573 and contact points 576, 564, and 560 of a rocker switch would comprise a metal such as copper. In the present invention, however, any or all of the side terminals 572 and 573, the contact points 560 and 564, and the rocker terminal 576 will comprise conductive resin-based material according to the present invention. In the preferred embodiment, the left side terminal 573 and left side contact point 564 and the right side terminal 572 and right side contact point 560 are molded of conductive resin-based material. The switch handle 555 is preferably molded of a non-conductive resin based material. However, the contact strip 576 on the bottom side of the handle 555 preferably comprises conductive resin-based material. For example, contact strip 576 may be mechanically inserted into the switch handle 555 or the switch handle may be over-molded onto the contact strip 576.

As an optional feature, a metal layer may be formed over the conductive loaded resin-based materials to alter the characteristics or the appearance of the conductive loaded resin-based materials. The metal layer may be formed by plating or by coating. If the method of formation is metal plating, then the resin-based structural material of the conductive loaded, resin-based material is one that can be metal plated. There are very many of the polymer resins that can be plated with metal layers. For example, GE Plastics, SUPEC, VALOX, ULTEM, CYCOLAC, UGIKRAL, STYRON, CYCOLOY are a few resin-based materials that can be metal plated. The metal layer may be formed by, for example, electroplating or physical vapor deposition.

Figure 2:
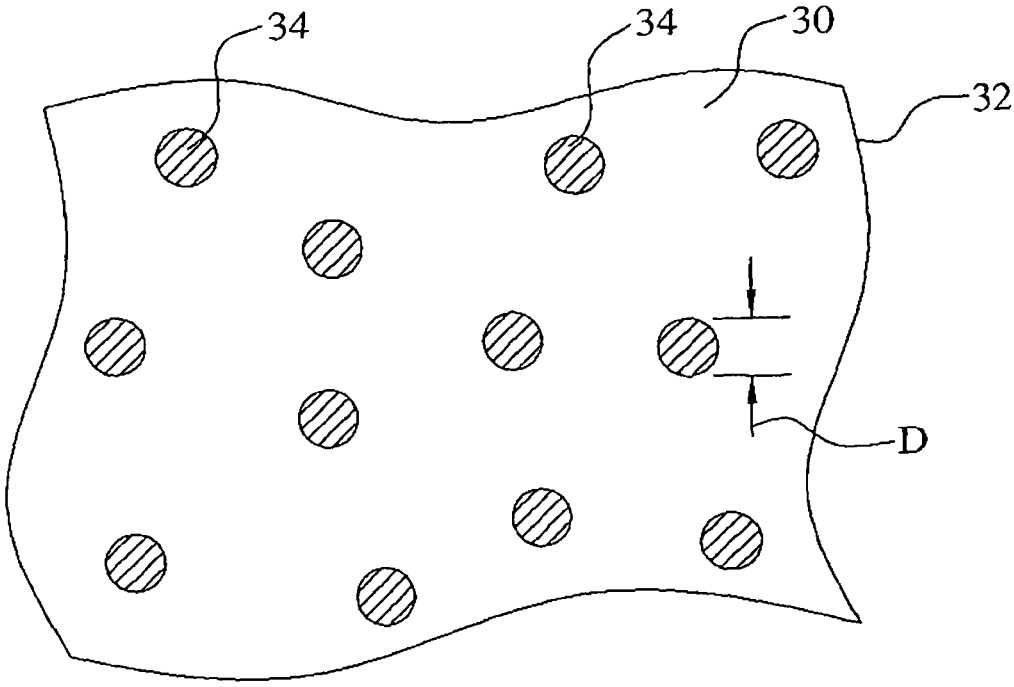
FIG. 2 illustrates a first preferred embodiment of a conductive loaded resin-based material wherein the conductive materials comprise a powder.

The conductive loaded resin-based material typically comprises a micron powder(s) of conductor particles and/or in combination of micron fiber(s) homogenized within a base resin host. FIG. 2 shows cross section view of an example of conductor loaded resin-based material 32 having powder of conductor particles 34 in a base resin host 30. In this example the diameter D of the conductor particles 34 in the powder is between about 3 and 12 microns.

Figure 3:
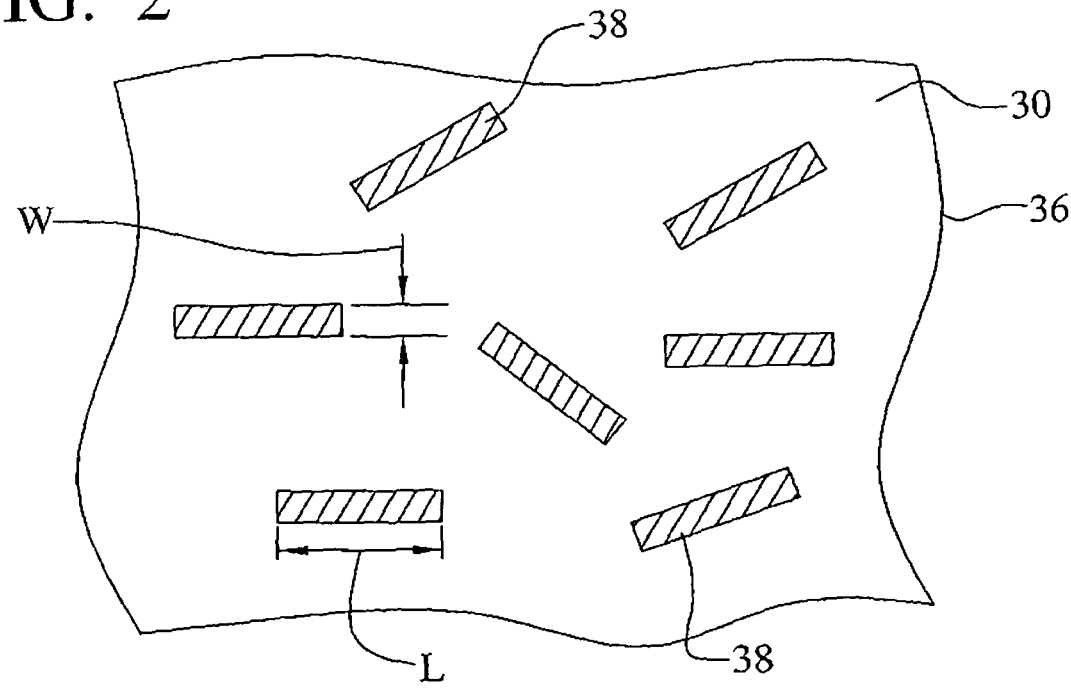
FIG. 3 illustrates a second preferred embodiment of a conductive loaded resin-based material wherein the conductive materials comprise micron conductive fibers.
Figure 4:
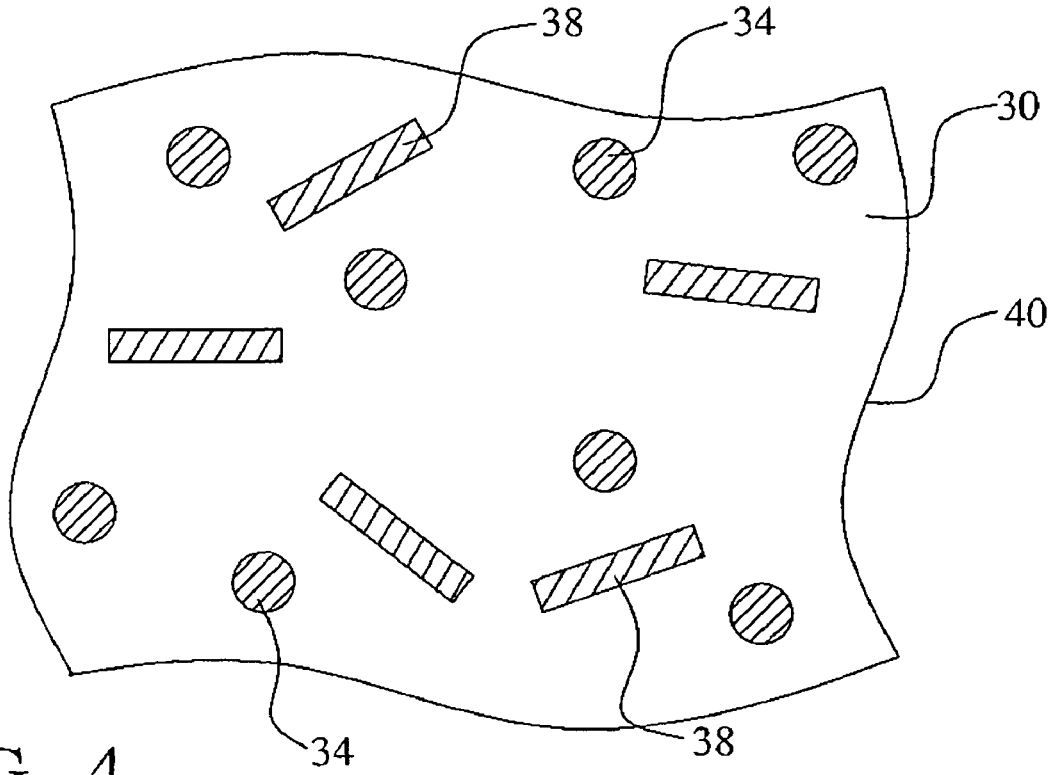
FIG. 4 illustrates a third preferred embodiment of a conductive loaded resin-based material wherein the conductive materials comprise both conductive powder and micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The conductors used for these conductor particles 34 or conductor fibers 38 can be stainless steel, nickel, copper, silver, or other suitable metals or conductive fibers, or combinations thereof. These conductor particles and or fibers are homogenized within a base resin. As previously mentioned, the conductive loaded resin-based materials have a resistivity between about 5 and 25 ohms per square, other resistivities can be achieved by varying the doping parameters and/or resin selection. To realize this resistivity the ratio of the weight of the conductor material, in this example the conductor particles 34 or conductor fibers 38, to the weight of the base resin host 30 is between about 0.20 and 0.40, and is preferably about 0.30. Stainless Steel Fiber of 8-11 micron in diameter and lengths of 4-6 mm with a fiber weight to base resin weight ratio of 0.30 will produce a very highly conductive parameter, efficient within any EMF spectrum. Referring now to FIG. 4, another preferred embodiment of the present invention is illustrated where the conductive materials comprise a combination of both conductive powders 34 and micron conductive fibers 38 homogenized together within the resin base 30 during a molding process.

Figure 5A:
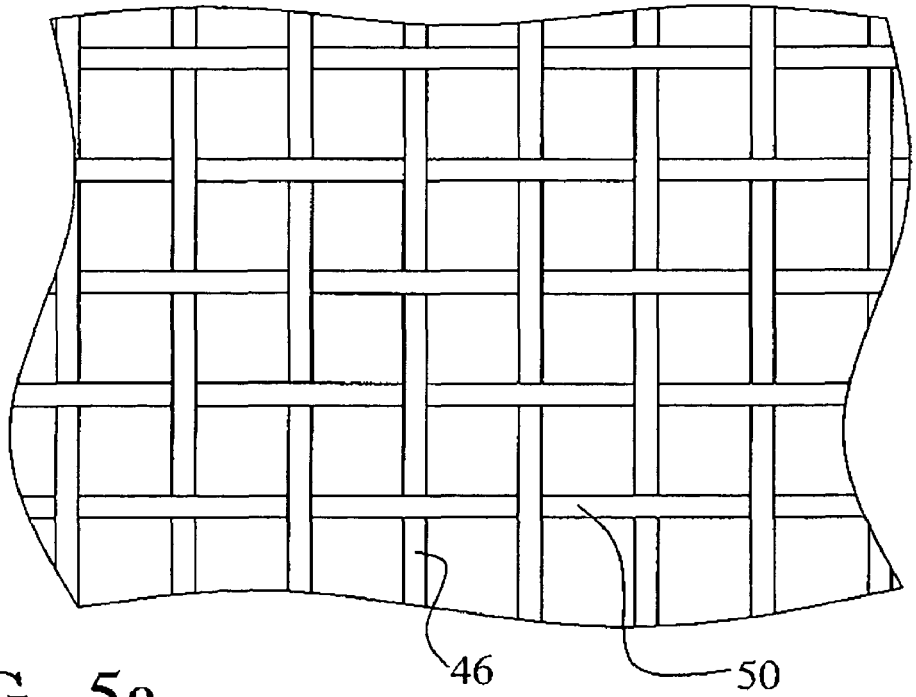
FIGS. 5*a* and 5*b* illustrate a fourth preferred embodiment wherein conductive fabric-like materials are formed from the conductive loaded resin-based material.
Figure 5B:
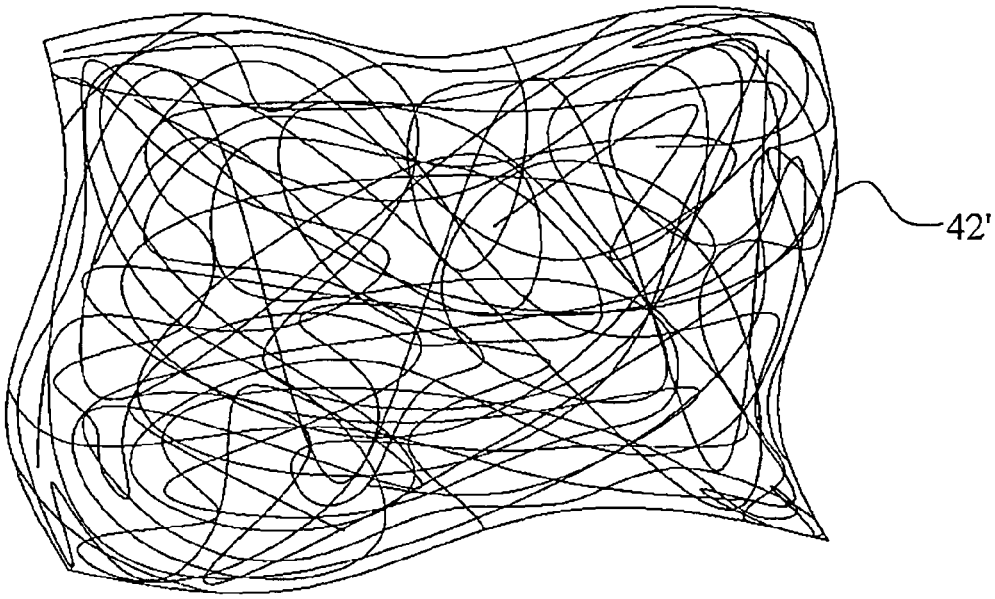

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
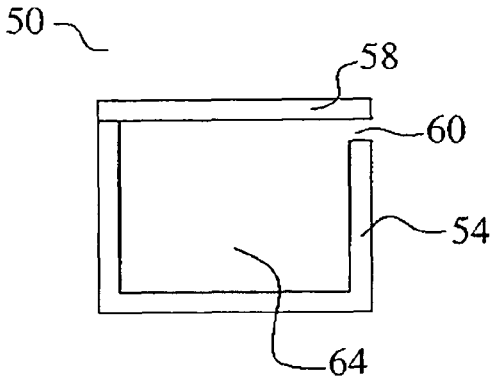
FIGS. 6*a* and 6*b* illustrate, in simplified schematic form, an injection molding apparatus and an extrusion molding apparatus that may be used to mold circuit conductors of a conductive loaded resin-based material.

Key actuators and other switching devices formed from conductive loaded resin-based materials can be formed or molded in a number of different ways including injection molding, extrusion or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the homogenized conductive material cures by thermal reaction. The upper portion 58 and lower portion 54 of the mold are then separated or parted and the key actuators or other switching devices are removed.

Figure 6B:
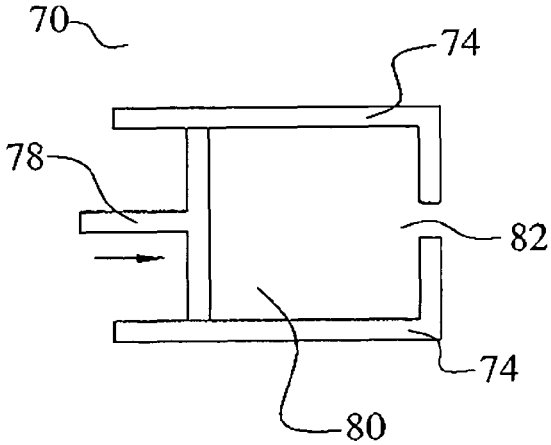

FIG. 6*b* shows a simplified schematic diagram of an extruder 70 for forming key actuators and other switching devices using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use.

The advantages of the present invention may now be summarized. An effective key actuator or other switching device is achieved. A method to form a key actuator or other switching device is achieved. A key actuator or other switching device is molded of conductive loaded resin-based materials. The key actuator or other switching device has a low manufacturing cost. The key actuator or other switching device has a low closed state resistance. The key actuator or other switching device exhibits a long life expectancy. The resistance or longevity characteristics of the key actuator or other switching device molded of conductive loaded resin-based material can be altered or the visual characteristics can be altered by forming a metal layer over the conductive loaded resin-based material. The key actuator or other switching device formed of conductive loaded resin-based material can incorporate various forms of the material.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A switching device comprising:

a first conductive terminal;

a second conductive terminal; and a conductive pill that moves between an open position and a closed position wherein said conductive pill directly contacts said first and said second conductive terminals such that said first and second conductive terminals are electrically connected in said closed position, wherein said first and said second conductive terminals are not electrically connected in said open position, and wherein said conductive pill comprises a conductive loaded, resin-based material comprising conductive materials in a base resin host wherein said conductive materials comprise micron conductive fiber having a diameter of between about 3 μm and about 12 μm and a length of between about 2 mm and about 14 mm.

2. The device according to claim 1 wherein the ratio, by weight, of said conductive materials to said resin host is between about 0.20 and about 0.40.

3. The device according to claim 1 wherein said micron conductive fiber is nickel plated carbon fiber, stainless steel fiber, copper fiber, silver fiber or combinations thereof.

4. The device according to claim 1 wherein said conductive materials further comprise conductive powder.

5. The device according to claim 1 wherein at least one of said first and second conductive terminals comprise a conductive loaded, resin-based material comprising conductive materials in a base resin host.

6. The device according to claim 1 wherein said movable conductive pill is fixably mounted on a keypad.

7. The device according to claim 6 wherein said keypad is part of an array of keypads on a keyboard device.

8. The device according to claim 6 wherein said array of keypads comprises a common membrane.

* * * * *